United States Patent [19]

Garavaglia

[11] 4,097,087

[45] Jun. 27, 1978

[54] CHAIR WITH ADJUSTABLE BACK SUPPORT CUSHION

[76] Inventor: Marco F. Garavaglia, 867 Briarcliff Dr., Grosse Pointe Woods, Mich. 48236

[21] Appl. No.: 796,838

[22] Filed: May 13, 1977

[51] Int. Cl.[2] ..... A47C 3/00

[52] U.S. Cl. ..... 297/284; 297/231; 297/353; 297/383

[58] Field of Search ..... 297/230, 231, 284, 383, 297/460, 353

[56] References Cited

U.S. PATENT DOCUMENTS

| | | | |
|---|---|---|---|
| 826,575 | 7/1906 | Hunter | 297/353 X |
| 1,181,224 | 2/1916 | Jaeger | 297/383 |
| 1,291,975 | 1/1919 | McNulty | 297/231 |
| 1,580,606 | 4/1926 | Jones | 297/284 UX |
| 1,734,179 | 11/1929 | Olson | 297/231 |
| 1,743,377 | 1/1930 | Nadell | 297/383 |
| 1,835,048 | 12/1931 | Hottel | 297/383 |

*Primary Examiner*—James C. Mitchell
*Attorney, Agent, or Firm*—Robert G. Mentag

[57] ABSTRACT

A back cushion assembly for a chair, including a back cushion portion on which is mounted a central, longitudinally disposed spine support cushion. A transversal lumbar support cushion is adjustably mounted on the back cushion portion in a position below the longitudinally disposed spine support cushion, for selective adjustment, up and down longitudinally of the back cushion portion, and toward and away from the back cushion portion.

9 Claims, 6 Drawing Figures

CHAIR WITH ADJUSTABLE BACK SUPPORT CUSHION

BACKGROUND OF THE INVENTION

1. Field of the Invention

This invention relates to the chair art, and more particularly, to contoured back cushions for use with the back portion of a chair.

2. Description of the Prior Art

It is well known in the chair art to provide contoured cushions on the chair back cushion portion. For example, U.S. Pat. No. 3,145,054 discloses a portable chair seat with a back-supporting pneumatic cushion which provides a longitudinal cushion and a transverse cushion. However, the last mentioned cushions are not adjustable. U.S. Pat. No. 3,279,849 shows a seat back having a vertically adjustable transverse, contoured cushion on its exterior, but it is not capable of being adjusted toward or away from the back portion of a chair. U.S. Pat. No. 3,106,423 shows a back rest having a plurality of adjustable, shaped elements, that are swingably mounted inside of a chair back cushion. A disadvantage of the prior art adjustable chair cushions shown in the aforementioned patents, is that they do not provide a longitudinal spine support cushion on the exterior of a chair back cushion which coacts with a transversal lumbar support cushion that can be adjusted along two planes perpendicular to each other.

SUMMARY OF THE INVENTION

This invention relates to the chair art, and in particular to contoured back cushions for use with the back portion of a chair, and which includes a fixed longitudinally disposed spine support cushion and a transversal lumbar support cushion which is adjustably mounted on the back portion of the chair in a position below the longitudinally disposed spine support cushion, for selective adjustment in two perpendicular planes.

It is an object of the present invention to provide an adjustable transversal lumbar support cushion which is adjustably mounted on the back portion of a chair for selective adjustment up and down longitudinally of the back portion, and toward and away from the back portion.

It is a further object of the present invention to provide an ajustable transversal lumbar support cushion for mounting on the back portion of a chair which may be quickly and easily adjusted to a position comfortable to each occupant of the chair.

It is still another object of the present invention to provide a contoured back cushion means for the back portion of a chair, and which includes a centrally disposed, longitudinally extended spine support cushion that is adapted to be fixedly mounted on the back portion of a chair, and an adjustable transversal lumbar support cushion disposed below the spine support cushion, and being adjustable up and down longitudinally of the back portion of a chair and toward and away from the back portion of a chair.

Other objects, features and advantages of the invention will be apparent from the following detailed description, appended claims and the accompanying drawings.

DETAILED DESCRIPTION OF THE PREFERRED EMBODIMENTS

Figure 1:
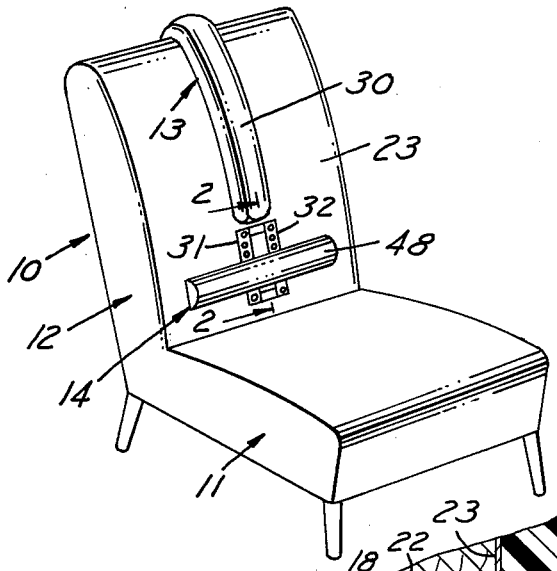
FIG. 1 is a perspective view of a chair structure with a back support cushion means made in accordance with the principles of the present invention.

Referring now to the drawings, and particularly to FIG. 1, the numeral 10 generally designates a conventional chair which includes a seat portion 11 and a back portion 12. The numeral 13 generally designates a longitudinal spine support cushion operatively mounted on the back portion 12 and made in accordance with the principles of the present invention. The numeral 14 generally designates an adjustable, transversal lumbar support cushion made in accordance with the principles of the present invention, and adjustably mounted on the chair back portion 12.

Figure 2:
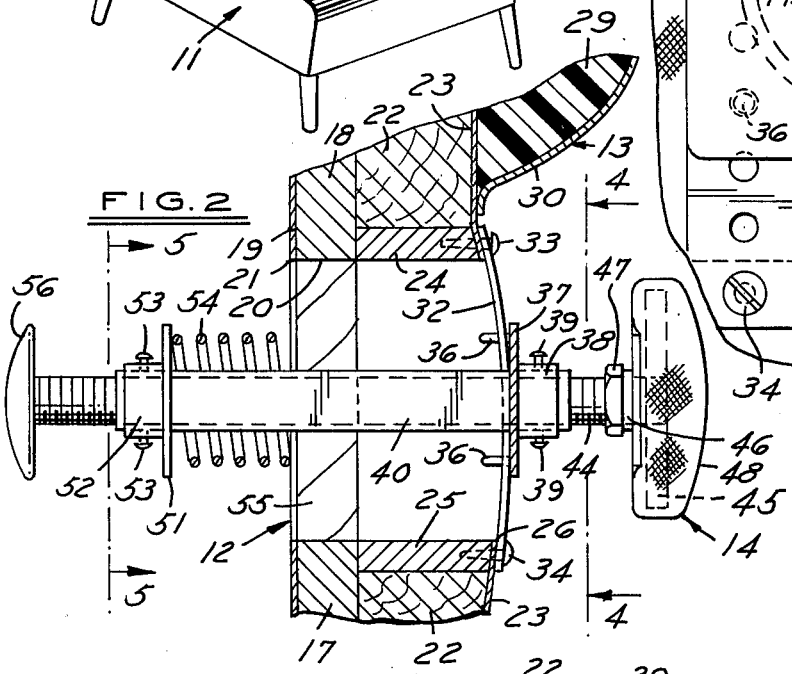
FIG. 2 is a fragmentary, enlarged elevation section view of the adjustable back support cushion means illustrated in FIG. 1, taken along the line 2—2 thereof, and looking in the direction of the arrows.

As shown in FIG. 2, the chair back portion 12 includes the usual back support structure including a pair of transverse frame members 17 and 18 which are made out of wood. The rear side of the chair back portion 12 is enclosed by a usual covering 19 which is made from any suitable material. The frame members 17 and 18 form an opening 20 through which is mounted the adjustable transversal lumbar support cushion 14. An opening 21 is formed through the chair covering 19 and it communicates with the opening 20.

A pair of forwardly extended frame members 24 and 25 are fixedly mounted on the front side of the transverse frame members 17 and 18, and they are secured thereto by any suitable means, as by a suitable adhesive, or screws (not shown). The chair back 12 includes the usual cushion material 22, made from any suitable material and which is covered on the front thereof by a suitable chair covering 23. The opening 26 in the cover 23, between the two frame members 24 and 25, communicates with the opening 20 between the frame members 17 and 18.

As shown in FIG. 1, the longitudinal spine support cushion 13 is positioned centrally on the front side of the chair back portion 12. The longitudinal spine support 13 extends from the upper end of the back portion 12 downwardly to a point immediately above the frame member 24. The longitudinal spine support cushion 13 may be made from any suitable resilient material 29 such as a foam rubber, a suitable plastic, or the like, and it is adhered to the front side of the cushion cover 23 by any suitable means, as by a suitable adhesive. The longitudinal spine support cushion 13 is preferably hemispherical in cross section shape, and it is covered with a suitable covering 30 which may be adhered to the cushion portion 29 by any suitable means, such as a suitable adhesive, or by stitching. (not shown).

Figure 4:
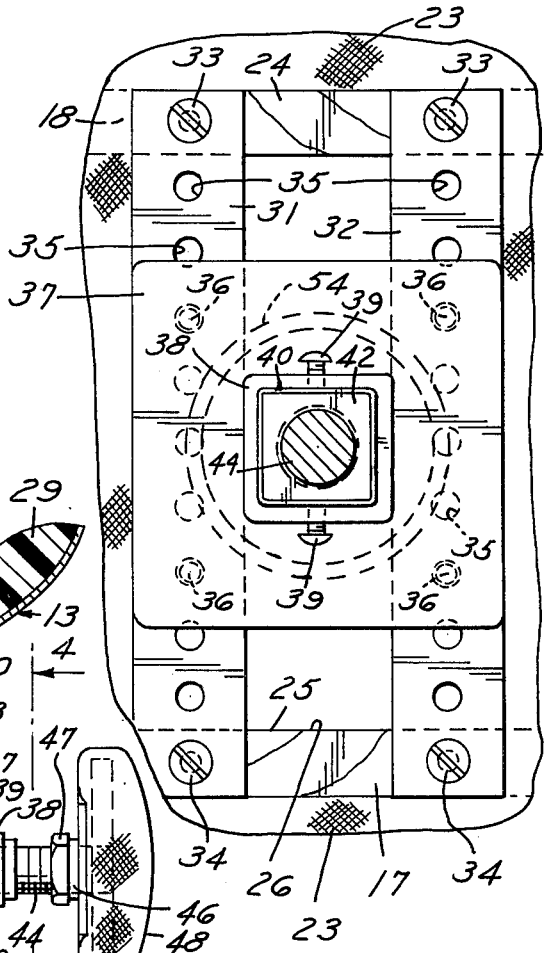
FIG. 4 is an enlarged, elevation view of the back support structure illustrated in FIG. 2, taken along the line 4—4 thereof, and looking in the direction of the arrows.

As best seen in FIG. 4, a pair of elongated rack members 31 and 32 are disposed on opposite sides of the opening through the chair back portion 12. The members 31 and 32 may be made from any suitable material, as for example, they may comprise a pair of suitable metal straps. Each of the rack members 31 and 32 are secured at their upper ends by suitable screws 33 to the transverse chair frame member 18. The lower ends of the rack members 31 and 32 are secured by suitable screws 34 to the lower transverse member 17. Each of the rack members 31 and 32 are provided with a plurality of longitudinally aligned, equally spaced apart holes 35.

Figure 3:
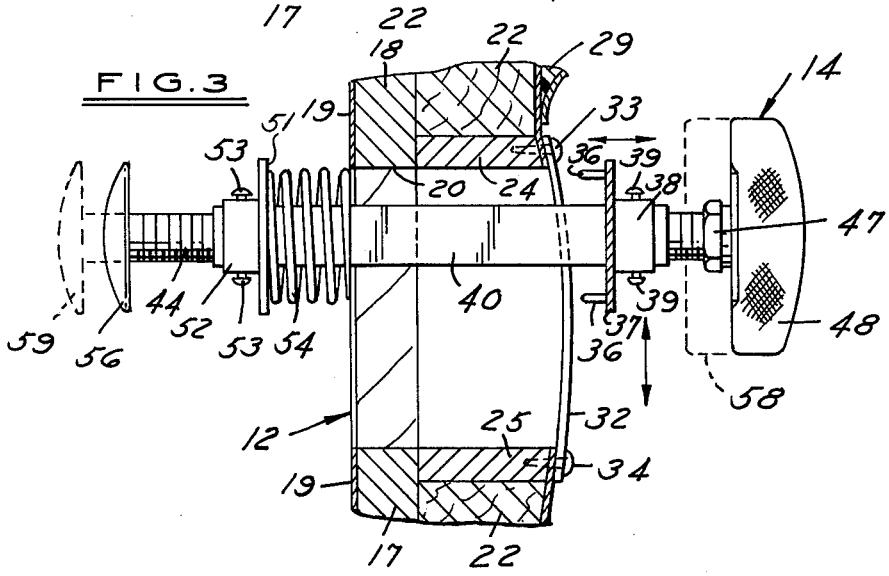
FIG. 3 is a view similar to FIG. 2, but showing the adjustable back support cushion in a position raised from that position shown in FIG. 2.

As shown in FIGS. 2, 3 and 4, the adjustable transversal lumbar support cushion means 14 include a plate or flange 37 which is provided on the rear side thereof with four fixedly mounted pins or prongs 36 which are adapted to be received in the holes 35 in the rack members 31 and 32. As best seen in FIG. 4, the prongs 36 are disposed with two of the same on each side of the flange 37, so that each of the straps 31 and 32 receive two of the prongs 36 in their respective opening 35.

As shown in FIGS. 2, 3 and 4, the flange 37 is fixed, as by welding, to a square, tubular sleeve 38 which is slidably mounted on an elongated square tubular mounting shaft 40. The tubular sleeve 38 is adapted to be fixed in an adjusted position on the tubular shaft 40 by a pair of suitable set screws 39.

Figure 5:
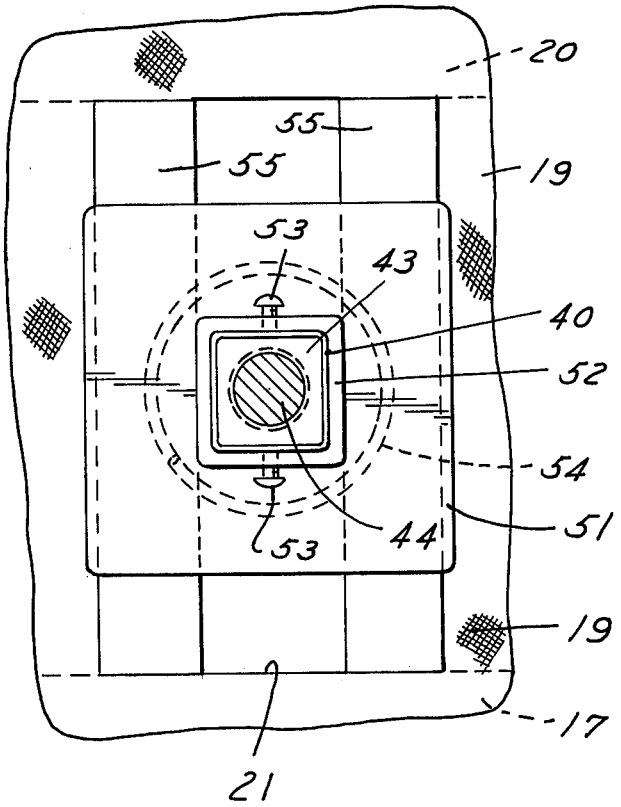
FIG. 5 is a fragmentary, enlarged, elevation view of the structure illustrated in FIG. 2, taken along the line 5—5 thereof, and looking in the direction of the arrows.

As shown in FIG. 4, a nut 42 is fixedly secured in the front end of the tubular shaft 40, by any suitable means, as by welding. As shown in FIG. 5, a similar nut 43 is also fixedly secured in the rear end of the tubular shaft 40. An elongated threaded shaft 44 is mounted through the tubular shaft 40, and it is threadably mounted in the nuts 42 and 43. As illustrated in FIG. 2, a rectangular cushion carrier plate 45 is fixedly secured on a threaded sleeve 46 which is threaded on the front end of the shaft 44 and locked in an adjusted position by a lock nut 47. A rectangular, transverse padded cushion 48 is operatively mounted on the rectangular carrier plate 45 and it extends transversely of the chair back portion 12, as shown in FIG. 1.

As shown in FIGS. 2, 3 and 5, a second rectangular flange 51 is slidably mounted on the rear end of the tubular shaft 40 in a position exterior of the back side of the chair back portion 12. The flage 51 is fixedly secured, as by welding to a square tubular sleeve 52 which is adapted to be secured in an adjusted position on the tubular shaft 40 by a pair of suitable set screws 53. A coil spring 54 is mounted around the tubular shaft 40, and it has its front end in sliding abutment with a pair of vertically spaced apart chair frame members 55, which are preferably made of wood, and secured between the transverse frame members 17 and 18. The rear end of the spring 54 abuts the front side of the flange 51. The spring 54 normally holds the transversal lumbar support cushion 14 in a desired adjusted position, as shown in FIG. 2. As shown in FIGS. 2 and 3, a suitable hand grip 56 is fixedly mounted by any suitable means on the rear end of the threaded shaft 44, and it may comprise a steel plate welded to the shaft 44 and covered with a suitable padding material.

In use, the longitudinal spine support cushion 13 provides a stationary cushion that is elevated from the back surface of the chair back portion 12. The longitudinal spine support cushion 13 is fixed to allow the shoulder blades of a user to assume a more correct posture when sitting on the chair 10, with his back against the cushion 13 and the chair back portion 12. The transversal lumbar support cushion 14 is used in a transverse position, as shown in FIG. 1, and it is padded and movable in two perpendicular planes. The cushion 14 may be adjusted up or down relative to the floor on which the chair 10 is disposed. The cushion 14 may also be adjusted in or out parallel to the plane of the floor on which the chair 10 is disposed. The adjustment of the transversal lumbar support cushion 14 is carried out by the user grasping the cushion 48 and then exerting a forward pulling pressure so as to move the shaft 40 forwardly of the chair back portion 12 to remove the pins 36 from their respective openings 35, so as to allow the cushion 14 to be moved upwardly or downwardly to a new desired adjusted vertical position. By releasing the pulling pressure on the cushion 48, the spring 54 functions to return the cushion 14 to the left, as viewed in FIGS. 2 and 3 into the new vertically disposed and locked position. The pad 14 may be adjusted inwardly and outwardly by rotating the pad 14, whereby the threaded shaft 44 may be threaded inwardly or outwardly of the tubular shaft 40. A further adjustment may be made by adjusting the positions of the tubular sleeves 38 and 52 relative to the tubular shaft 40.

Figure 6:
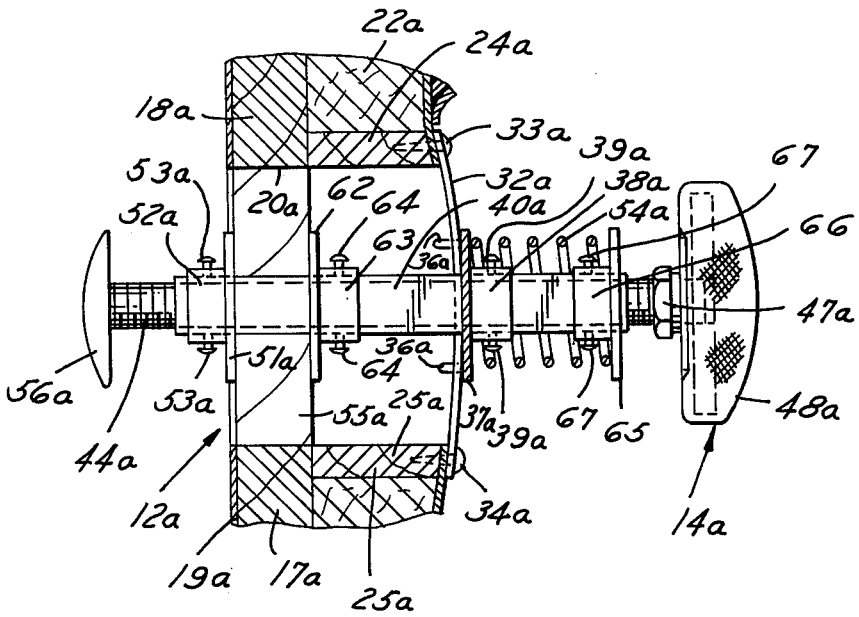
FIG. 6 is an elevation section view similar to FIG. 2, and showing a second embodiment of the invention.

FIG. 6 illustrates a second embodiment of the invention, and the parts of this embodiment which are the same as the embodiment of FIGS. 1 through 5 have been marked with the same reference numerals, followed by the small letter "*a*". The embodiment of FIG. 6 includes a third flange 62 which is fixedly secured, as by welding, to a square tubular sleeve 63 that is slidably mounted on the elongated tubular shaft **40*a*. The tubular sleeve 63 is secured in an adjusted position on the tubular shaft 40*a* by a pair of set screws 64. As shown in FIG. 6, the rear flange 51*a* is positioned so as to be slidably mounted against the rear faces of the frame members 55*a*. The flange 62 is secured in position on the shaft 40*a* so that the flanges 62 and 51*a* are slidable on the chair frame members 55*a*. A fourth flange 65 is fixed, as by welding, to a square tubular sleeve 66 that is secured in an adjusted position on the front end of the elongated tubular shaft 40*a* by a pair of suitable machine screws 67. As shown in FIG. 6, the flange 37*a* with the prongs 36*a* is positioned inwardly of the flange 65, and the return spring 54*a* is mounted between the flange 37*a* and the flange 65. In order to adjust the transversal lumbar support cushion 14*a* upwardly and downwardly, the user first releases the set screws 39*a* to permit the sleeve 38*a* to slide freely on the shaft 40*a*. The user then grasps the flange 37*a* and pulls it forwardly, or to the right, as viewed in FIG. 6, so as to remove the pins 36*a* from the holes in the back members 31*a* and 32*a*, whereby the shaft 40*a* may be adjusted upwardly or downwardly with the flanges 51*a* and 62 sliding on the vertical pair of frame members 55*a*. The cushion 48*a* may be adjusted inwardly or outwardly by rotating the shaft 44*a*, in the desired position. After the cushion 48*a* is moved upwardly or downwardly to the new desired position, the flange 37*a* is released and the prongs 36*a* hold the cushion 48*a* in the new adjusted position due to the pressure of the spring 54*a*. The set screws 39*a* may then be tightened to provide a means for locking the cushion 48*a* in the new position. If desired, the set screws 39*a* could be deleted in the embodiment of FIG. 6**.

It will be seen that the transversal lumbar support cushion 14 may be quickly and easily adjusted to a desired selected position, to provide a contour which provides the greatest degree of comfort for an occupant of a chair. The transversal lumbar support cushion 14 may be adjusted for each successive occupant of a chair, and in a position chosen to provide the greatest comfort to the particular occupant of a chair. It will be understood that the shaft 44*a* could also be slidably mounted in the tubular shaft 40*a* by any suitable means, instead of being threadably mounted, as shown.

While it will be apparent that the preferred embodiments of the invention herein disclosed are well calculated to fulfill the objects above stated, it will be appreciated that the invention susceptible to modification, variation and change.

What is claimed is:

1. In a back assembly for a chair, the combination comprising:

(a) a back portion;

(b) a transversal lumbar support cushion;

(c) means for adjustably mounting said transversal lumbar support cushion on said back portion for selective adjustment up and down longitudinally of the back portion and toward and away from said back portion; and, (d) a centrally disposed, longitudinal spine support cushion fixedly mounted on said back portion in a position above the transversal lumbar support cushion and extending to the top end of the back portion.

2. A back assembly for a chair as defined in claim 1, wherein:

(a) said means for adjustably mounting said transversal lumbar support cushion on said back portion includes, a support member for adjustably mounting said transversal lumbar support cushion on said back portion, and means for releasably holding said support member in a longitudinally adjusted position on the back portion.

3. A back assembly for a chair as defined in claim 2, wherein:

(a) said means for adjustably mounting said transversal lumbar support cushion on said back portion includes means for adjustably mounting said transversal lumbar support cushion on said support member for adjusting the transversal lumbar support cushion toward or away from said back portion.

4. A back assembly for a chair as defined in claim 3, wherein:

(a) said back portion is provided with an opening extending therethrough, from the back to the front thereof;

(b) said support member is adjustably mounted in said opening in said back portion; and, (c) said means for adjustably mounting said transversal support cushion on said back portion includes a rack means carried by said back portion adjacent said opening through the back portion, and a holding means mounted on said support member and adapted to be detachably engaged with said rack means for holding the support member in a longitudinally adjusted position on said back portion.

5. A back assembly for a chair as defined in claim 4, wherein:

(a) said means for adjustably mounting said transversal support cushion on said back portion includes a spring means for releasably holding said support member holding means in holding engagement with said rack means mounted on said back portion.

6. A back assembly for a chair as defined in claim 5, wherein:

said spring means is operatively mounted on the back side of the back portion.

7. A back assembly for a chair as defined in claim 5, wherein:

(a) said spring means is operatively mounted on the front side of said back portion.

8. A back assembly for a chair as defined in claim 5, wherein:

(a) said support member comprises an elongated tubular shaft, and said means for adjustably mounting the transversal lumbar support cushion on the support member includes an elongated shaft which is movably mounted through said tubular shaft for adjusting the position of the transversal lumbar support cushion toward or away from said back portion.

9. A back assembly for a chair as defined in claim 8, wherein:

(a) said holding means includes a flange means carried on said tubular shaft, said rack means is provided with a plurality of holes, and said holding means is provided with a plurality of prongs which are adapted to be releasably mounted in said holes in said rack means.

* * * * *